United States Patent [19]

Shivers

[11] Patent Number: 4,914,846

[45] Date of Patent: Apr. 10, 1990

[54] GUN HAMMER COCKING APPARATUS USABLE WITH A HAMMER LOCKING DEVICE EXTENDING ABOUT THE HAMMER

[76] Inventor: Horace L. Shivers, 21 Fillmore St., Trenton, N.J. 08638

[21] Appl. No.: 383,487

[22] Filed: Jul. 24, 1989

[51] Int. Cl.[4] ..... F41C 27/00; F41C 17/08

[52] U.S. Cl. ..... 42/65; 42/69.03; 42/70.08; 42/66

[58] Field of Search ..... 42/65, 66, 45, 69.03, 42/70.08

[56] References Cited

U.S. PATENT DOCUMENTS

| | | | |
|---|---|---|---|
| 290,867 | 12/1883 | Deyo | 42/70.08 |
| 561,963 | 6/1896 | Caldwell | 42/70.08 |
| 774,712 | 11/1904 | Vold | 42/70.08 |
| 835,349 | 11/1906 | Deming | 42/70.08 |
| 2,527,957 | 10/1950 | Phillips | 42/70.08 |
| 2,994,981 | 8/1961 | Carrigan | 42/70.08 |
| 3,422,560 | 1/1969 | Foote et al. | 42/70.06 |
| 3,624,945 | 12/1971 | Foote | 42/70.11 |
| 4,014,123 | 3/1977 | Williams | 42/70.11 |
| 4,299,045 | 11/1981 | Cervantes | 42/70.11 |
| 4,392,318 | 7/1983 | Daniels | 42/70.11 |

FOREIGN PATENT DOCUMENTS 975770 11/1964 United Kingdom ..... 42/70.11

*Primary Examiner*—Charles T. Jordan
*Assistant Examiner*—Michael J. Carone
*Attorney, Agent, or Firm*—Sperry, Zoda & Kane

[57] ABSTRACT

The present invention provides an apparatus which allows cocking of the hammer of a gun whenever a gun is utilized with a casing which encases the upper rear portion of the gun preventing manual access by a user directly to the hammer itself. The apparatus of the present invention includes a cocking bar and a cocking lever both movably mounted with respect to the casing such that downward movement of the cocking lever will facilitate downward movement of the cocking bar causing cocking movement of the gun hammer itself without requiring direct access to the hammer surface by the user. Preferably the cocking bar is movably mounted within left and right cocking slots defined in the side walls of the casing. Resilient spring biasing means are preferably positioned adjacent each slot to facilitate movement of the cocking bar to the steady state uppermost position whenever downward pressure is not being exerted upon the cocking lever itself or upon a tab extending outwardly from the rear section thereof.

22 Claims, 5 Drawing Sheets

GUN HAMMER COCKING APPARATUS USABLE WITH A HAMMER LOCKING DEVICE EXTENDING ABOUT THE HAMMER

BACKGROUND OF THE INVENTION

1. Field Of The Invention

The present invention deals with the field of devices usable with single action handguns. With single or double action handguns it is preferable to provide a means for preventing accidental discharge thereof and such means can include a casing completely encompassing the hammer thereof such as shown in U.S. Ser. No. 260,770 filed Oct. 21, 1988, now U.S. Pat. No. 4,864,760. That apparatus provides multiple rings extending about the hammer which must be properly oriented to allow cocking movement of the hammer.

The present invention provides a means for facilitating cocking of such a hammer for use with single action handguns wherein direct access to the hammer has heretofore been necessary to facilitate downward movement thereof for cocking thereof. The present invention provides a means for cocking of such single action weapons even though a casing completely encapsulates the hammer area and prevents direct access thereto by a user.

2. Description Of The Prior Art

Prior art devices for controlling hand usage include various configurations of safety locks, examples of which are shown in the following patents: U.S. Pat. No. 561,963 issued June 16, 1896 to H. M. Caldwell on a Revolver; U.S. Pat. No. 774,712 issued Nov. 8, 1904 to O. G. Vold on a Safety Device For Firearms; U.S. Pat. No. 2,527,957 issued Oct. 31, 1950 to J. Phillips on a Hammer Guard For Firearms; U.S. Pat. No. 2,994,981 issued Aug. 8, 1961 to C. E. Carrigan on a Hammer Safety Lock For Firearms; U.S. Pat. No. 3,422,560 issued Jan. 21, 1969 to T. C. Foote et al on Adjustable Gun Trigger Locks; U.S. Pat. No. 3,624,945 issued Dec. 7, 1971 to D. J. Foote on Universal Self-Conforming Trigger Lock For Firearms; U.S. Pat. No. 4,014,123 issued Mar. 291, 977 to Coral C. Williams on a Firearm Safety Device and U.S. Pat. No. 4,299,045 issued Nov. 10, 1981 to Ramon H. Cervantes on a Backplate For A Detachable Gun Lock.

SUMMARY OF THE INVENTION

The present invention provides a gun hammer cocking apparatus which is particularly usable with a hammer locking device which extends about the hammer such as to prevent direct access thereto. The hammer locking device with which the present invention is usable often will completely encapsulate the hammer of the firearm and as such an access means is required whenever single action firearms utilize such a protection device.

The cocking apparatus of the present invention includes a casing attached with respect to the gun wherein the casing is hollow in such a manner as to define an interior chamber therein extending about the hammer. The casing further defines an arcuate left cocking slot and an arcuate right cocking slot therein. The casing includes a left pivot stud extending outwardly therefrom adjacent the left cocking slot and may preferably also include a right pivot stud extending outwardly therefrom adjacent the right cocking slot.

The cocking apparatus includes a cocking bar means positioned within the casing above the gun hammer which extends generally horizontally between the left cocking slot and the right cocking slot and extends into both slots. The cocking bar device preferably includes an interior cocking bar extending generally horizontally between the left and right cocking slots at a position above the gun hammer. The interior cocking bar is larger in diameter than the width of the left cocking slot and the right cocking slot to facilitate retainment thereof within the interior chamber. A left cocking bar arm is secured to the interior cocking bar and extends therefrom through the left cocking slot to facilitate movement thereof. In a similar manner the right cocking bar arm extends from the interior cocking bar through the right cocking slot to facilitate movement therealong.

A left biasing means preferably comprising a left spring means is mounted on the casing adjacent the left cocking slot. The left spring means is adapted to abut the left cocking bar arm to urge the cocking bar means upwardly to a steady state position above the gun hammer. In a similar manner a right biasing means such as a right spring means is mounted with respect to the casing adjacent the right cocking slot. The right spring means is adapted to abut the right cocking bar arm to urge the cocking bar means upwardly to a steady state position above the gun hammer. A cocking lever device is pivotally mounted externally with respect to the casing and may include a left cocking lever arm pivotally mounted with respect to the casing and adapted to abut the left cocking bar arm to move same downwardly to facilitate cocking of the gun hammer. The left cocking lever arm defines a left pivot aperture therein adapted to receive the left pivot stud extending therein to facilitate pivotal movement of the left cocking lever arm with respect to the casing.

In a similar manner the cocking lever device may include a right cocking lever arm pivotally mounted on the casing adapted to abut the right cocking bar arm and move it downwardly to facilitate cocking of the gun hammer. The right cocking lever arm defines a right pivot aperture therein adapted to receive the right pivot stud extending therein to facilitate pivotal movement of the right cocking lever arm with respect to the casing.

The cocking lever also may include a lever cocking section extending between the left cocking lever arm and the right cocking lever arm to control movement thereof. The lever cocking section is responsive to downward movement to facilitate cocking of the gun hammer. The lever cocking section includes a tab extending outwardly therefrom to facilitate a user in exerting downwardly directed pressure on the lever cocking section. The tab is responsive to this downwardly directed force being exerted thereon to urge the right cocking lever arm and the left cocking lever arm to move downwardly against the bias exerted by the left biasing means and the right biasing means in such a manner as to abut the left cocking bar arm and the right cocking bar arm for urging the interior cocking bar into abutment with respect to the gun hammer to facilitate cocking.

A left housing may also be included secured with respect to the casing adjacent the left cocking slot defined therein. The left housing may be adapted to retain the left spring means therein to facilitate biasing of the cocking bar means into the steady state position above the gun hammer. In a similar manner a right housing may be secured with respect to the casing adjacent the right cocking slot. The right housing is adapted to retain the right spring means therein to facilitate biasing of the cocking bar into the steady state position above the gun hammer.

A left cover may be secured with respect to the casing in such a manner as to extend over the left cocking slot as well as the left spring means and the left cocking lever in such a manner as to protect and contain these parts. In a similar manner a right cover may be secured with respect to the casing such as to extend over the right cocking slot, the right spring means and the right cocking lever arm to facilitate protection and containment of these parts.

It is an object of the present invention to provide a gun hammer cocking apparatus usable with a hammer locking device extending about the hammer wherein cocking of the gun hammer of a single action handgun is made possible.

It is an object of the present invention to provide a gun hammer cocking apparatus usable with a hammer locking device extending about the hammer wherein cocking of the gun hammer of a firearm which is efficiently and effectively protected from accidental discharge is made possible.

It is an object of the present invention to provide a gun hammer cocking apparatus usable with a hammer locking device extending about the hammer wherein the hammer locking device which completely encapsulates the hammer of a firearm is made usable with single action firearms.

It is an object of the present invention to provide a gun hammer cocking apparatus usable with a hammer locking device extending about the hammer wherein a minimum number of moving parts is utilized.

It is an object of the present invention to provide a gun hammer cocking apparatus usable with a hammer locking device extending about the hammer wherein maintenance requirements are minimized.

It is an object of the present invention to provide a gun hammer cocking apparatus usable with a hammer locking device extending about the hammer wherein initial capital outlay cost is minimized.

It is an object of the present invention to provide a gun hammer cocking apparatus usable with a hammer locking device extending about the hammer wherein usability with single or double action firearms is made possible.

It is an object of the present invention to provide a gun hammer cocking apparatus usable with a hammer locking device extending about the hammer wherein cocking of the gun hammer of a single action handgun is made possible without providing direct access thereto by a user.

It is an object of the present invention to provide a gun hammer cocking apparatus usable with a hammer locking device extending about the hammer wherein cocking of the gun hammer is made possible without compromising the effectiveness of a completely encapsulating firearm discharge protection device.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
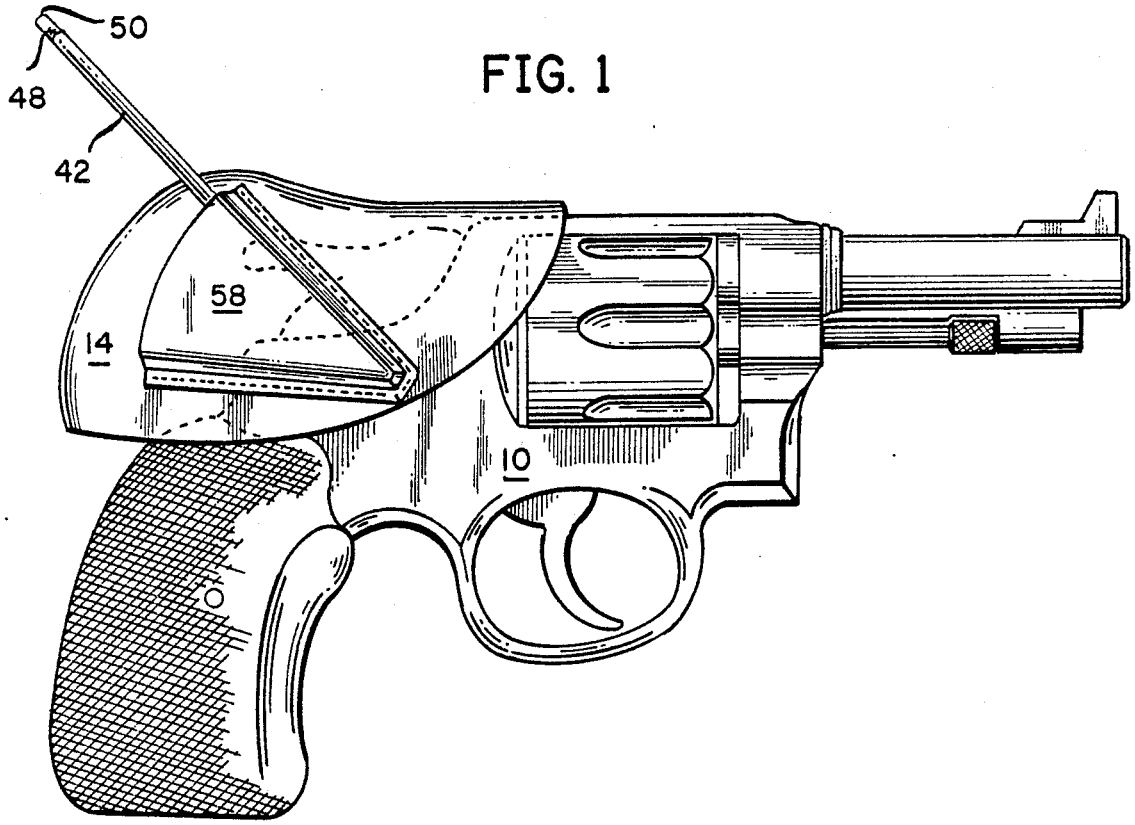
FIG. 1 is a side plan view of an embodiment of the gun hammer cocking apparatus of the present invention shown in position upon a firearm.
Figure 2:
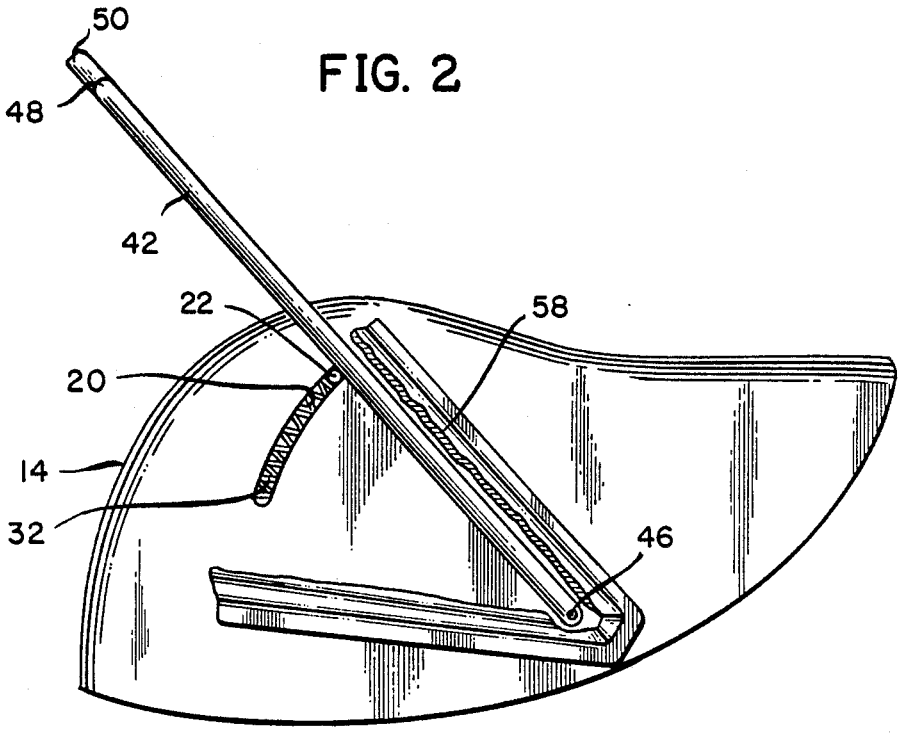
FIG. 2 is a partially broken away side plan view of an embodiment of the gun hammer cocking apparatus illustrating the right cocking slot therein.
Figure 3:
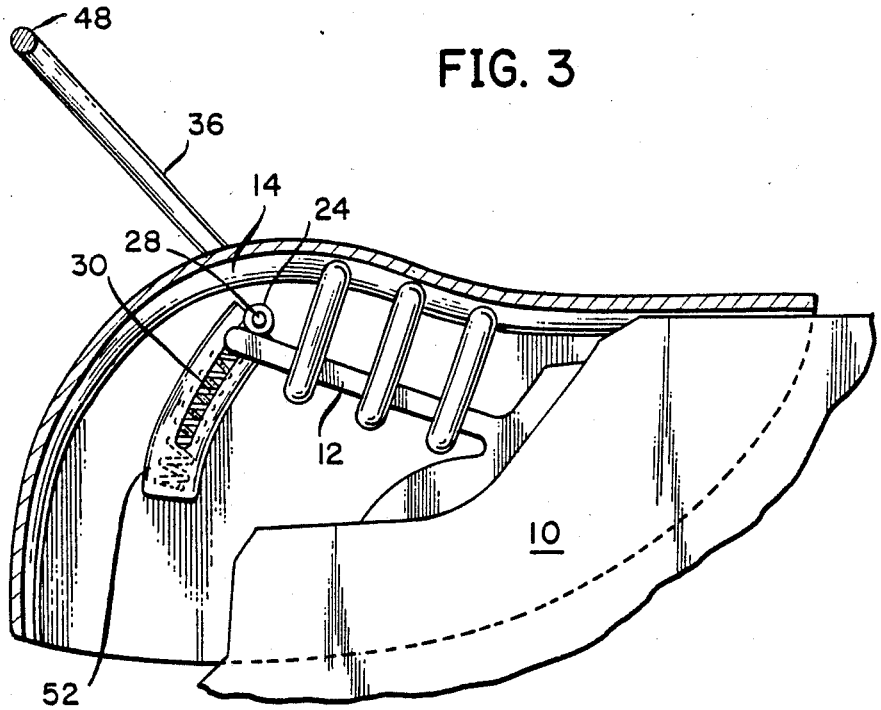
FIG. 3 is a cross-sectional view of an embodiment of the casing of the present invention illustrating the three ring hammer securement means and an embodiment of the left cocking slot apparatus.
Figure 4:
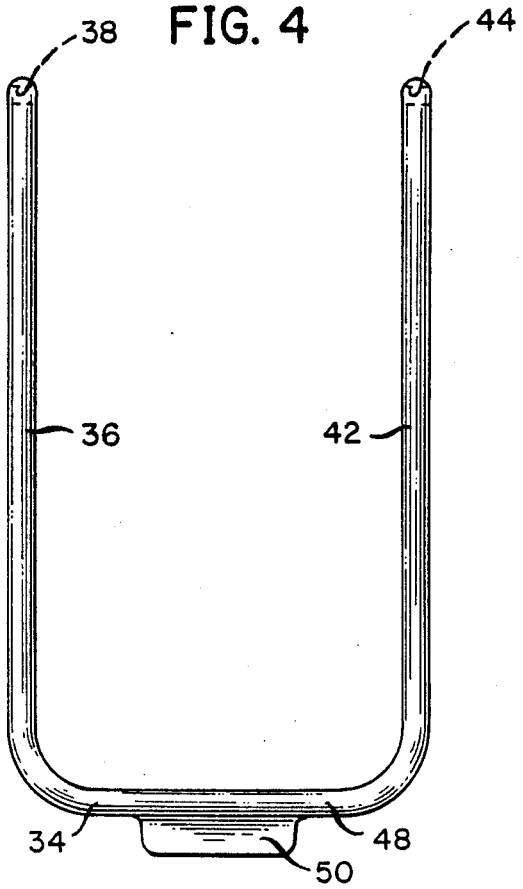
FIG. 4 is a top plan view of an embodiment of the cocking lever means of the present invention.
Figure 5:
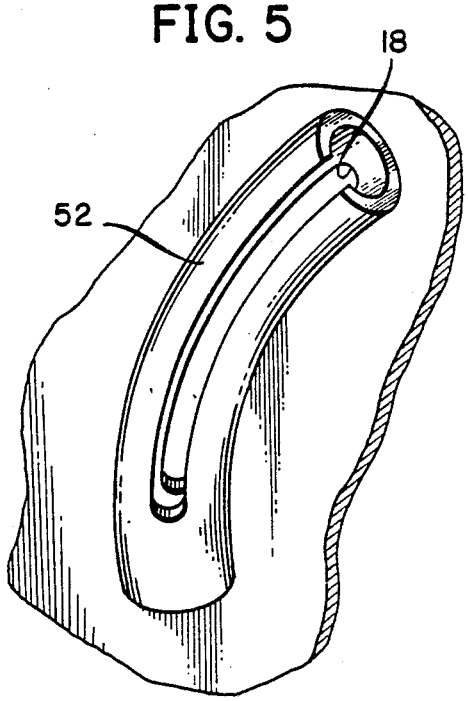
FIG. 5 is a partial cross-sectional view of an embodiment of the left housing means of the present invention.
Figure 6:
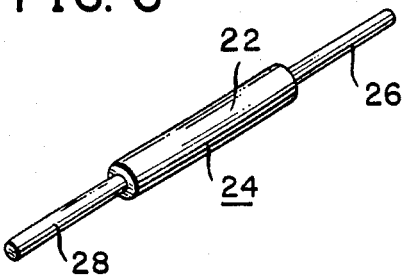
FIG. 6 is a front perspective view of an embodiment of the cocking bar means of the present invention.
Figure 7:
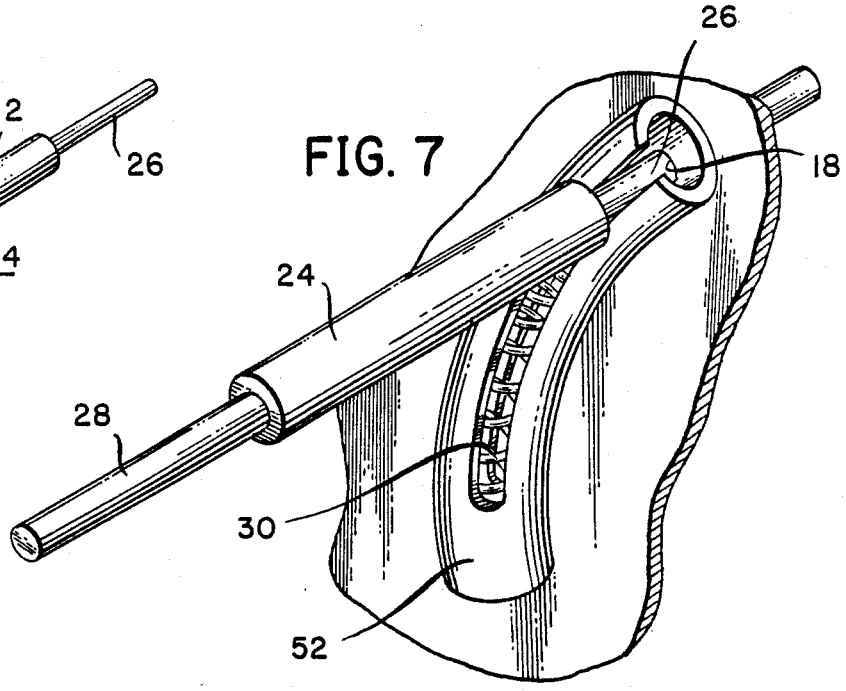
FIG. 7 is a perspective illustration of an embodiment of the left housing means of the present invention.
Figure 8:
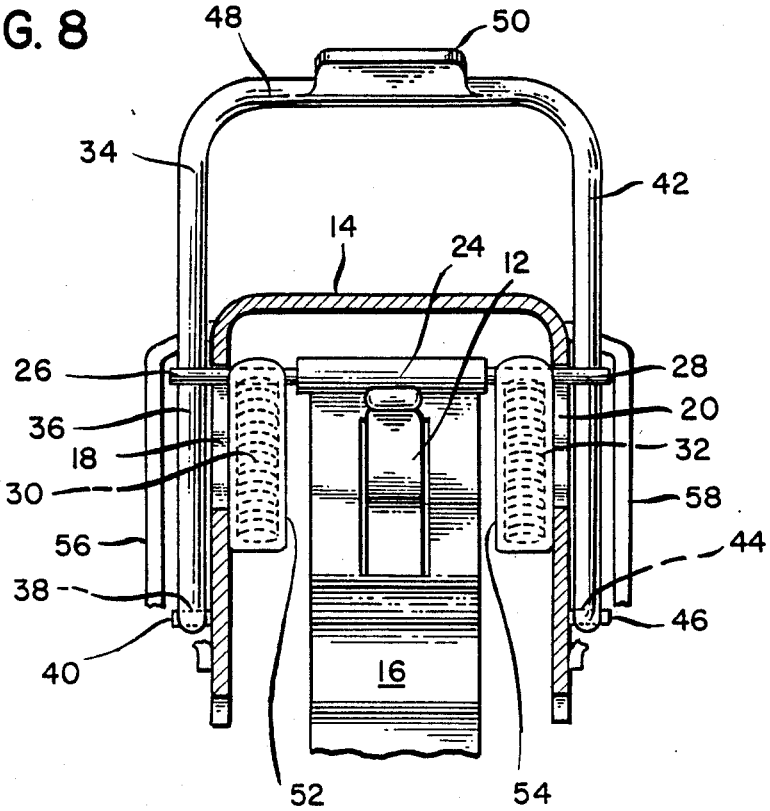
FIG. 8 is a top cross-sectional view of an embodiment of the gun hammer cocking apparatus of the present invention.
Figure 9:
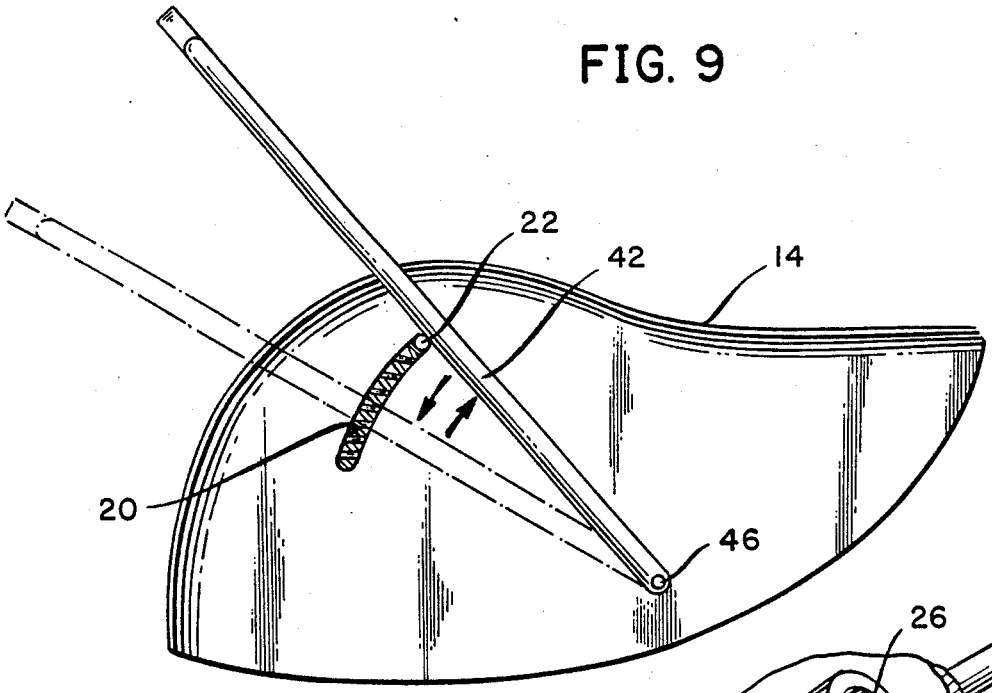
FIG. 9 is a right plan view of an embodiment of the gun hammer cocking apparatus of the present invention with the right cover means removed therefrom for the purposes of illustration.

The present invention provides a gun hammer cocking apparatus which is particularly usable with a hammer locking device extending about the gun hammer 12 of a gun 10 as shown in FIG. 1. The hammer locking device preferably includes a casing 14 with which the gun hammer cocking apparatus of the present invention is operable.

Casing 14 defines an interior chamber 16 having a left cocking slot 18 and a right cocking slot 20 defined therein. Left cocking slot 18 is in communication with respect to the interior chamber 16 and right cocking slot 20 is also in communication with interior chamber 16. A cocking bar means 22 preferably extends between the left cocking slot 18 and the right cocking slot 20 and is mounted therein.

Cocking bar means 22 preferably includes an interior cocking bar 24 with a left cocking bar arm 26 extending generally horizontally outwardly therefrom into the left cocking slot 18. In a similar fashion cocking bar 22 includes a right cocking bar arm 28 extending generally horizontally outwardly from the interior cocking bar 24 such as to extend into the right cocking slot 20. Movement of the right cocking bar arm 28 along right cocking slot 20 and movement of left cocking bar arm 26 along left cocking slot 18 will facilitate generally vertical movement of interior cocking bar 24 within interior chamber 16. Preferably the interior cocking bar 24 is of a larger diameter than the width of the left cocking slot 18 or the right cocking slot 20 in such a manner as to prevent movement of the interior cocking bar section 24 into either of these two slot means.

Figure 10:
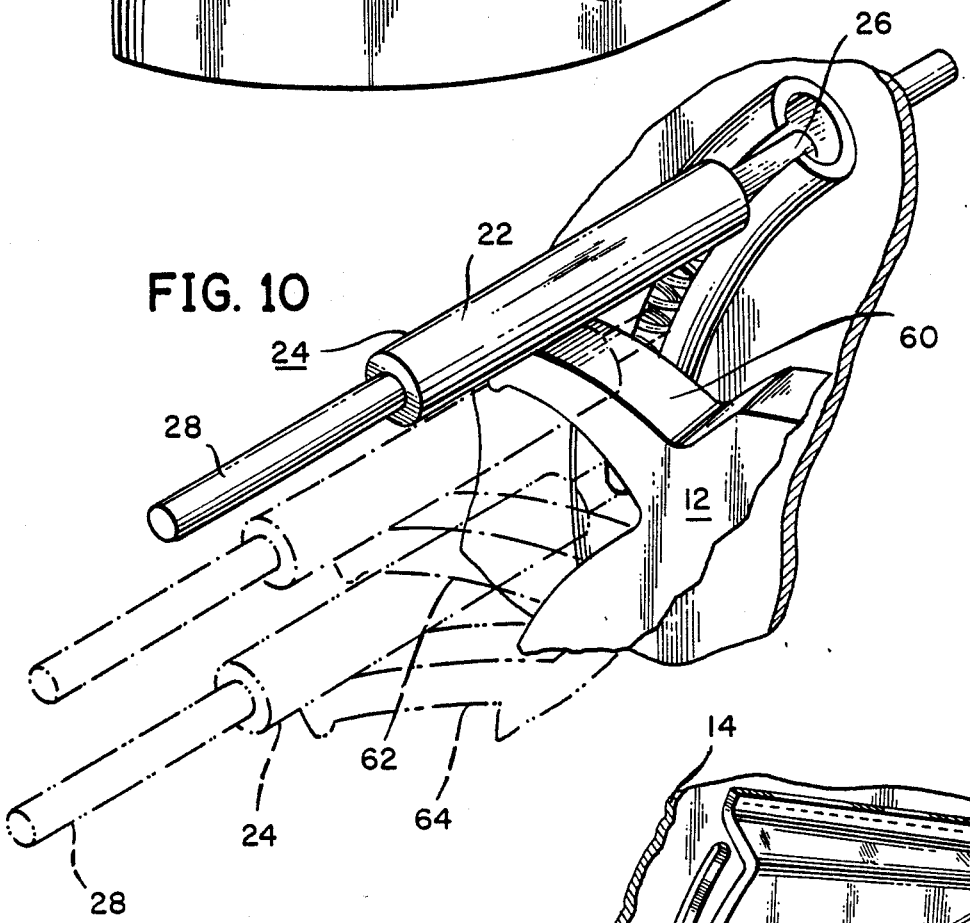
FIG. 10 is a right plan view of an embodiment of the cocking bar and the gun hammer with the gun hammer shown in the uncocked position in full lines and in the partially cocked position and fully cocked position in dotted outline.
Figure 11:
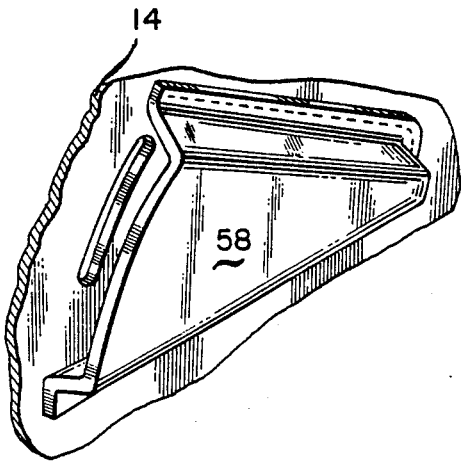
FIG. 11 is a side perspective view of an embodiment of the right cover means of the present invention.
Figure 12:
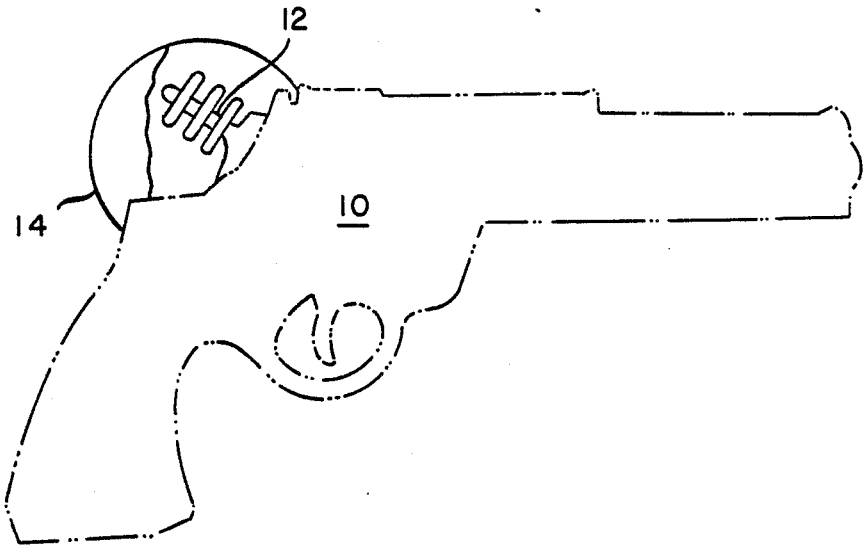
FIG. 12 (PRIOR ART)
FIG. 12 is a side plan view of prior art shown in U.S. Ser. No. 260,770 filed 10/21/88, now U.S. Pat. No. 4,814,760
Figure 13:
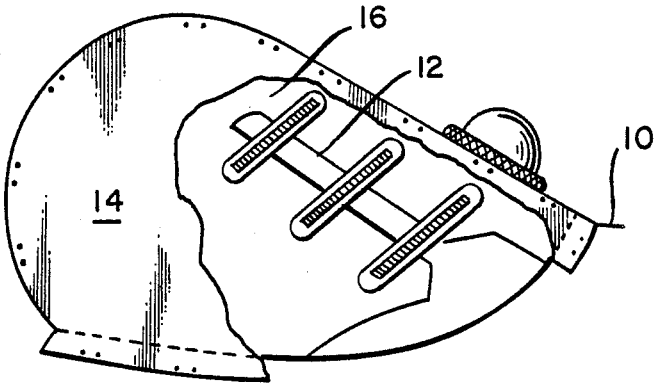
FIG. 13 (PRIOR ART)
FIG. 13 is a side plan view of prior art shown in U.S. Ser. No. 260,770 filed 10/21/88, now U.S. Pat. No. 4,864,760.

A left biasing means such as a left spring means 30 may be mounted with respect to the casing 14 in a position immediately adjacent the left cocking slot 18. In a similar manner the right biasing means or right spring means 32 may be mounted with respect to the casing 14 in a position immediately adjacent the right cocking slot 20. To facilitate retainment of the left and right biasing means 30 and 32 with respect to the left and right cocking slots 18 and 20 there adjacent housing means may be included. For example a left housing means 52 may be defined extending along the left cocking slot 18 such as to be adapted to hold the left spring means 30 therein. In a similar manner a right housing means 54 may be positioned extending along the right cocking slot 20 such as to retain the right biasing means or right spring means 32 therein. In this manner the left and right biasing means 30 and 32 will be adapted to urge the left and right cocking bar arms 26 and 28 and thus the cocking bar means 22 itself into the uppermost position of the left and right cocking slots 18 and 20. This will be the steady state position. The cocking bar means 22 and in particular the interior cocking bar 24 thereof will be adapted to extend horizontally at a position immediately above the gun hammer 12 when in the steady state uppermost position. In this position the gun hammer 12 will be in the uncocked position 60 as best shown in FIG. 10.

In order to control movement of the cocking bar means 22 a cocking lever means 34 may be positioned extending about the casing 14. The cocking lever 34 preferably includes a left cocking lever arm 36 and a right cocking lever arm 42. Left cocking lever arm 36 preferably defines a left pivot aperture 38 therein. The casing 14 preferably includes a left pivot stud 40 extending outwardly therefrom adjacent the left cocking slot 18. In this manner the left cocking lever arm 36 will be positioned with the left pivot aperture 38 thereof in position to receive the left pivot stud 40 to facilitate pivotal movement of the left cocking lever arm 36 with respect to casing 14.

In a similar manner a right pivot aperture 44 will be defined in the right cocking lever arm 42. Also the casing 14 will define a right pivot stud 46 positioned adjacent the right cocking slot 20 thereof. The right pivot aperture 44 of right cocking lever arm 42 will be adapted to receive the right pivot stud 46 to facilitate pivotal movement of right cocking lever arm 42 with respect to casing 14.

A lever cocking section 48 will extend between the left cocking lever arm 36 and the right cocking lever arm 42 in such a manner as to making the left and right lever arms simultaneously movable. Lever cocking section 48 will also include a tab means 50 if found to be necessary extending outwardly therefrom to facilitate the user in exerting downwardly directed force on the lever cocking section 48 and more generally upon the cocking lever means 34.

In the preferred configuration of the present invention the left cocking bar arm 26 will extend through the left cocking slot 18 outwardly to the exterior of casing 14. In a similar manner the right cocking bar arm 28 will extend through the right cocking slot 20 to a position outwardly with respect to the casing 14.

The left cocking lever arm 36 of cocking lever means 34 will be positioned above the left cocking bar arm 26 and will be adapted to abut the upper surface thereof for exerting downwardly directed bias thereon. In a similar manner the right cocking lever arm 42 will extend adjacent the casing 14 to abut the upper surface of the right cocking bar arm 28 to facilitate the exertion of downward bias thereon.

It should be appreciated that the interior cocking bar 28 extends between the left cocking bar arm 26 and the right cocking bar arm 28 at a position immediately above the gun hammer 12. As such when in operation in the present invention whenever a downwardly directed bias is exerted upon the lever cocking section 48 or the tab means 50 the cocking lever means 34 will move downwardly pivotally with respect to the casing 14. This downward movement will cause abutment of the cocking lever 34 with respect to the upper surface of the left cocking bar arm 26 and the right cocking bar arm 28 in such a manner as to cause downward movement of the cocking bar means 22. Downward movement of cocking bar means 22 will naturally result in downward movement of the interior cocking bar 24. Downward movement of bar 24 will cause the gun hammer 12 to move downwardly as shown best in FIG. 10. In full line the gun hammer 12 is shown in the uncocked position 60. In dotted outline the gun hammer 12 is shown in the partially cocked position 62 and finally in the lowermost fully cocked position 64. The user will then release the downward pressure being exerted upon the upper surface of the lever cocking section 48 or the tab means 50 which will allow the left and right spring biasing means 30 and 32 to exert upwardly directed pressure on the left and right cocking bar arms 26 and 28 causing them to move upwardly to the steady state uppermost position defined within the left cocking slot 18 and the right cocking slot 20.

Once the firearm is discharged this procedure can be repeated for multiple firing of a firearm and is particularly usable with single action handguns.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A gun hammer cocking apparatus, being usable with a hammer locking device extending about the hammer preventing direct access thereto, which comprises:

(a) a casing attached with respect to the gun, said casing being hollow to define an interior chamber therein extending about the hammer thereof, said casing further defining a left cocking slot and a right cocking slot therein;

(b) a cocking bar means positioned within said casing above the gun hammer and extending generally horizontally through said left cocking slot and through said right cocking slot, said cocking bar means comprising:

(1) an interior cocking bar extending generally horizontally between said left cocking slot and said right cocking slot at a position above the gun hammer;

(2) a left cocking bar arm extending from said interior cocking bar through said left cocking slot to facilitate movement therealong;

(3) a right cocking bar arm extending from said interior cocking bar through said right cocking slot to facilitate movement therealong;

(c) a left biasing means mounted with respect to said casing adjacent said left cocking slot, said left resilient biasing means adapted to abut said left cocking bar arm to urge said cocking bar means to a steady state position above the gun hammer;

(d) a right biasing means mounted with respect to said casing adjacent said right cocking slot, said right resilient biasing means adapted to abut said right cocking bar arm to urge said cocking bar means to a steady state position above the gun hammer;

(e) a cocking lever means pivotally mounted externally with respect to said casing and further including:

(1) a left cocking lever arm pivotally mounted with respect to said casing and being adapted to abut said left cocking bar arm to move same to facilitate cocking of the gun hammer;

(2) a right cocking lever arm pivotally mounted on said casing and being adapted to abut said right cocking bar arm to move same to facilitate cocking of the gun hammer; and (3) a lever cocking section extending between said left cocking lever arm and said right cocking lever arm to control movement thereof and to facilitate cocking of the gun hammer.

2. A gun hammer cocking apparatus, being usable with a hammer locking device extending about the hammer preventing direct access thereto, as defined in claim 1 further comprising a left housing means secured with respect to said casing adjacent said left cocking slot defined therein, said left housing means adapted to retain said left biasing means therein to facilitate biasing of said cocking bar means into the steady state position above the gun hammer.

3. A gun hammer cocking apparatus, being usable with a hammer locking device extending about the hammer preventing direct access thereto, as defined in claim 1 further comprising a right housing means secured with respect to said casing adjacent said right cocking slot defined therein, said right housing means adapted to retain said right biasing means therein to facilitate biasing of said cocking bar means into the steady state position above the gun hammer.

4. A gun hammer cocking apparatus, being usable with a hammer locking device extending about the hammer preventing direct access thereto, as defined in claim 1 wherein said left biasing means comprises a left spring means.

5. A gun hammer cocking apparatus, being usable with a hammer locking device extending about the hammer preventing direct access thereto, as defined in claim 1 wherein said right biasing means comprises a right spring means.

6. A gun hammer cocking apparatus, being usable with a hammer locking device extending about the hammer preventing direct access thereto, as defined in claim 1 wherein said interior cocking bar is larger in diameter than said left cocking bar and said right cocking bar to facilitate retainment thereof within said interior chamber.

7. A gun hammer cocking apparatus, being usable with a hammer locking device extending about the hammer preventing direct access thereto, as defined in claim 6 wherein said interior cocking bar is larger in diameter that the width of said left cocking slot and said right cocking slot to facilitate retainment thereof within said interior chamber.

8. A gun hammer cocking apparatus, being usable with a hammer locking device extending about the hammer preventing direct access thereto, as defined in claim 1 wherein said lever cocking section includes a tab means extending outwardly therefrom to facilitate a user in exerting downwardly directed force thereon.

9. A gun hammer cocking apparatus, being usable with a hammer locking device extending about the hammer preventing direct access thereto, as defined in claim 1 wherein said casing includes a left pivot stud extending outwardly from said casing adjacent said left cocking slot.

10. A gun hammer cocking apparatus, being usable with a hammer locking device extending about the hammer preventing direct access thereto, as defined in claim 9 wherein said left cocking lever arm defines a left pivot aperture therein adapted to receive said left pivot stud extending therein to facilitate pivotal movement of said left cocking lever arm with respect to said casing.

11. A gun hammer cocking apparatus, being usable with a hammer locking device extending about the hammer preventing direct access thereto, as defined in claim 1 wherein said casing includes a right pivot stud extending outwardly from said casing adjacent said right cocking slot.

12. A gun hammer cocking apparatus, being usable with a hammer locking device extending about the hammer preventing direct access thereto, as defined in claim 11 wherein said right cocking lever arm defines a right pivot aperture therein adapted to receive said right pivot stud extending therein to facilitate pivotal movement of said right cocking lever arm with respect to said casing.

13. A gun hammer cocking apparatus, being usable with a hammer locking device extending about the hammer preventing direct access thereto, as defined in claim 1 further comprising a left cover means secured with respect to said casing and extending over said left cocking slot, said left biasing means and said left cocking lever arm to facilitate protection and containment thereof.

14. A gun hammer cocking apparatus, being usable with a hammer locking device extending about the hammer preventing direct access thereto, as defined in claim 1 further comprising a right cover means secured with respect to said casing and extending over said right cocking slot, said right biasing means and said right cocking lever arm to facilitate protection and containment thereof.

15. A gun hammer cocking apparatus, being usable with a hammer locking device extending about the hammer preventing direct access thereto, as defined in claim 1 wherein said left cocking slot is arcuate to define an arcuate movement path for said left cocking bar arm.

16. A gun hammer cocking apparatus, being usable with a hammer locking device extending about the hammer preventing direct access thereto, as defined in claim 1 wherein said right cocking slot is arcuate to define an arcuate movement path for said right cocking bar arm.

17. A gun hammer cocking apparatus, being usable with a hammer locking device extending about the hammer preventing direct access thereto, as defined in claim 1 wherein said left biasing means is adapted to urge said left cocking bar arm to the uppermost position within said left cocking slot.

18. A gun hammer cooking apparatus, being usable with a hammer locking device extending about the hammer preventing direct access thereto, as defined in claim 1 wherein said right biasing means is adapted to urge said right cocking bar arm to the uppermost position within said right cocking slot.

19. A gun hammer cocking apparatus, being usable with a hammer locking device extending about the hammer preventing direct access thereto, as defined in claim 1 wherein downwardly directed force exerted upon said lever cocking section is responsive to urge said right cocking lever arm and said left cocking lever arm to move downwardly against the bias exerted by said left biasing means and said right biasing means to abut said left cocking bar arm and said right cocking bar arm to urge said interior cocking bar into abutment with respect to the gun hammer to facilitate cocking thereof.

20. A gun hammer cocking apparatus, being usable with a hammer locking device extending about the hammer preventing direct access thereto, as defined in claim 1 wherein said left cocking lever arm is pivotally mounted with respect to said casing and is adapted to abut said left cocking bar arm to move same downwardly to effect cocking of the gun hammer.

21. A gun hammer cocking apparatus, being usable with a hammer locking device extending about the hammer preventing direct access thereto, as defined in claim 1 wherein said right cocking lever arm is pivotally mounted with respect to said casing and is adapted to abut said right cocking bar arm to move same downwardly to effect cocking of the gun hammer.

22. A gun hammer cocking apparatus, being usable with a hammer locking device extending about the hammer preventing direct access thereto, which comprises:

(a) a casing attached with respect to the gun, said casing being hollow to define an interior chamber therein extending about the hammer thereof, said casing further defining an arcuate left cocking slot and an arcuate right cocking slot therein, said casing including a left pivot stud extending outwardly therefrom adjacent said left cocking slot and further including a right pivot stud extending outwardly therefrom adjacent said right cocking slot;

(b) a cocking bar means positioned within said casing above the gun hammer and extending generally horizontally through said left cocking slot and through said right cocking slot, said cocking bar means comprising:

(1) an interior cocking bar extending generally horizontally between said left cocking slot and said right cocking slot at a position above the gun hammer, said interior cocking bar being larger in diameter than the width of said left cocking slot and said right cocking slot to facilitate retainment thereof within said interior chamber;

(2) a left cocking bar arm extending from said interior cocking bar through said left cocking slot to facilitate movement therealong;

(3) a right cocking bar arm extending from said interior cocking bar through said right cocking slot to facilitate movement therealong;

(c) a left biasing means comprising a left spring means mounted with respect to said casing adjacent said left cocking slot, said left resilient biasing means adapted to abut said left cocking bar arm to urge said cocking bar means upwardly to a steady state position above the gun hammer;

(d) a right biasing means comprising a right spring means mounted with respect to said casing adjacent said right cocking slot, said right resilient biasing means adapted to abut said right cocking bar arm to urge said cocking bar means upwardly to a steady state position above the gun hammer;

(e) a cocking lever means pivotally mounted externally with respect to said casing and further including:

(1) a left cocking lever arm pivotally mounted with respect to said casing and being adapted to abut said left cocking bar arm to move same downwardly to facilitate cocking of the gun hammer, said left cocking lever arm defining a left pivot aperture therein adapted to receive said left pivot stud extending therein to facilitate pivotal movement of said left cocking lever arm with respect to said casing;

(2) a right cocking lever arm pivotally mounted on said casing and being adapted to abut said right cocking bar arm to move same downwardly to facilitate cocking of the gun hammer, said right cocking lever arm defining a right pivot aperture therein adapted to receive said right pivot stud extending therein to facilitate pivotal movement of said right cocking lever arm with respect to said casing;

(3) a lever cocking section extending between said left cocking lever arm and said right cocking lever arm to control movement thereof and being responsive to downward movement thereof to facilitate cocking of the gun hammer, said lever cocking section including a tab means extending outwardly therefrom to facilitate a user in exerting downwardly directed force thereon, said tab means being responsive to downwardly directed force being exerted thereon to urge said right cocking lever arm and said left cocking lever arm to move downwardly against the bias exerted by said left biasing means and said right biasing means to abut said left cocking bar arm and said right cocking bar arm to urge said interior cocking bar into abutment with respect to the gun hammer to facilitate cocking thereof;

(f) a left housing means secured with respect to said casing adjacent said left cocking slot defined therein, said left housing means adapted to retain said left biasing means therein to facilitate biasing of said cocking bar means into the steady state position above the gun hammer;

(g) a right housing means secured with respect to said casing adjacent said right cocking slot defined therein, said right housing means adapted to retain said right biasing means therein to facilitate biasing of said cocking bar means into the steady state position above the gun hammer;

(h) a left cover means secured with respect to said casing and extending over said left cocking slot, said left biasing means and said left cocking lever arm to facilitate protection and containment thereof; and (i) a right cover means secured with respect to said casing and extending over said right cocking slot, said right biasing means and said right cocking lever arm to facilitate protection and containment thereof.

* * * * *